US006850191B1

(12) United States Patent
Thill et al.

(10) Patent No.: US 6,850,191 B1
(45) Date of Patent: Feb. 1, 2005

(54) DUAL FREQUENCY BAND COMMUNICATION ANTENNA

(75) Inventors: Kevin M. Thill, Scottsdale, AZ (US); Bill Liimatainen, Monroe, WI (US)

(73) Assignee: Antenna Plus, LLC, Scottsdale, AZ (US)

( * ) Notice: Subject to any disclaimer, the term of this patent is extended or adjusted under 35 U.S.C. 154(b) by 0 days.

(21) Appl. No.: 10/014,071

(22) Filed: Dec. 11, 2001

(51) Int. Cl.[7] ..... H01Q 1/38
(52) U.S. Cl. ..... 343/700 MS; 343/830
(58) Field of Search ..... 343/700 MS, 702, 343/713, 829, 830, 846, 848, 853; H01Q 1/38

(56) References Cited

U.S. PATENT DOCUMENTS

| | | | | |
|---|---|---|---|---|
| 4,089,003 A | | 5/1978 | Conroy | |
| 4,162,499 A | * | 7/1979 | Jones et al. | 343/700 MS |
| 4,218,682 A | | 8/1980 | Yu | |
| 4,414,550 A | * | 11/1983 | Tresselt | 343/700 MS |
| 4,521,781 A | * | 6/1985 | Campi et al. | 343/700 MS |
| 5,041,838 A | | 8/1991 | Liimatainen et al. | |
| 5,121,127 A | | 6/1992 | Torivama | |
| 5,323,168 A | | 6/1994 | Itoh et al. | |
| 5,438,338 A | | 8/1995 | Thill | |
| 5,568,155 A | | 10/1996 | Tsunekawa et al. | |
| 5,625,365 A | | 4/1997 | Tom et al. | |
| 5,786,793 A | * | 7/1998 | Maeda et al. | 343/700 MS |
| 5,801,660 A | * | 9/1998 | Ohtsuka et al. | 343/700 MS |
| 6,087,990 A | | 7/2000 | Thill et al. | |
| 6,181,280 B1 | * | 1/2002 | Kadambi et al. | 343/700 MS |
| 6,441,787 B1 | * | 8/2002 | Richards et al. | 343/700 MS |

* cited by examiner

*Primary Examiner*—Tho Phan
(74) *Attorney, Agent, or Firm*—George E. Haas; Quarles & Brady LLP

(57) ABSTRACT

An antenna assembly has a pair of disk-shaped antennae each tuned to a different frequency band thereby enabling the same antenna to be used to different types of communication equipment, such as cellular and PCS telephones. The first antenna has a first substrate with first and second conductive layers applied to its major surfaces, and the second antenna has a second substrate with third and fourth conductive layers applied to its major surfaces. A primary shunt extends between the first and second conductive layers to tune the first antenna, and a secondary shunt extends between the third and fourth conductive layers to tune the second antenna. The first and second antennae abut with the first conductive layer contacting the fourth conductive layer. A pair of electrical conductors are connected to different ones of the second and third conductive layers to carry communication signals to the antenna assembly.

22 Claims, 1 Drawing Sheet

DUAL FREQUENCY BAND COMMUNICATION ANTENNA

CROSS-REFERENCE TO RELATED APPLICATIONS

Not Applicable

STATEMENT REGARDING FEDERALLY SPONSORED RESEARCH OF DEVELOPMENT

Not Applicable

BACKGROUND OF THE INVENTION

1. Field of the Invention

The present invention relates to antennae for two-way communication, such as wireless telephones, and more particularly to planar antennae for such application.

2. Description of the Related Art

Wireless telephones, such as cellular and PCS telephones, commonly are used for mobile communication with passengers in vehicles. Such telephones usually have a hand-held unit which includes a microphone, a small speaker and a keypad for placing calls and controlling the operation of the telephone. The hand-held unit is coupled by a cable to an electronics module that contains a radio frequency transceiver. The transceiver in turn is coupled to an antenna on the exterior of the vehicle to send and receive the radio frequency signals. Cellular telephones transmit in the 824 to 845 MHz frequency band and receive signals in the 870 to 896 MHz frequency band. PCS telephones operate in the 1885 to 1990 MHz frequency band. Thus, an antenna that is tuned to operate with one type of these telephones would not be optimum for use with the other type.

A typical cellular telephone antenna for a motor vehicle is attached to the exterior surface of a window and comprises a short section of rigid wire extending vertically from the vehicle body. A coupling box is mounted on the interior surface of the window opposite to the antenna and is connected by a coaxial cable to the transceiver. The coupling box and the antenna are electrically coupled so that signals from the transmitter section of the transceiver are applied to the exterior wire from which the signals radiate. The coupling also allows radio frequency signals to be received by the exterior element and applied to the receiver section of the transceiver.

Even though such cellular telephone antennae are relatively short, protruding approximately one foot from the surface of the vehicle, they are subject to accidental breakage, such as in automatic car washes, and acts of vandalism. Although cellular telephone antennae are considered by some people to be a status symbol, others may consider them to be unsightly and a detraction from the aesthetic appearance of the vehicle.

U.S. Pat. No. 5,041,838 discloses a low profile, flat disk-shaped antenna for bidirectional communication, such as cellular telephones. This antenna is attached to a horizontal exterior surface of the motor vehicle, such as the roof. A coaxial cable extends through a hole in that surface, coupling the external antenna to the transceiver inside the motor vehicle. This antenna is tuned to a single frequency band.

U.S. Pat. No. 6,087,990 discloses a low profile, flat disk-shaped antenna assembly that combines two antennae into a single package. One antenna is tuned for bidirectional communication equipment, such as cellular telephones, while the other antenna in designed for another type of radio frequency equipment, such as a global positioning system receiver. Separate coaxial cables for each type of equipment connect to this dual antenna assembly.

SUMMARY OF THE INVENTION

A dual frequency band antenna assembly according to the present invention comprises a first antenna and a second antenna. The first antenna includes a first planar substrate of dielectric material, that preferably is disk-shaped. The first substrate has two major surfaces with a first electrically conductive layer on one of those surfaces and a second electrically conductive layer on the other major surface. At least one primary electrical shunt is connected to the first and second electrically conductive layers.

The second antenna comprises a second planar substrate of dielectric material, that preferably also is disk-shaped. The second substrate has a pair of major surfaces, one of the pair of major surfaces has a third electrically conductive layer thereon and the other one of the pair of major surfaces faces the first antenna. The second antenna includes at least one secondary electrical shunt connecting the third electrically conductive layer to the first electrically conductive layer of the first antenna. In the preferred embodiment, the other one of the pair of major surfaces has a fourth conductive layer thereon and abutting the first conductive layer of the first antenna. In this latter version, the secondary electrical shunt connects the third electrically and fourth conductive layers.

A pair of electrical conductors is provided to carry communication signals to and from the antenna assembly. A first one of these conductors is connected to the second electrically conductive layer, while the other conductor is connected to the third electrically conductive layer.

Placement of the primary and secondary electrical shunts tunes the first and second antennae to different frequency bands. Thus enables the same antenna to be usable with different types of communication equipment. For example, when the antenna assembly is connected to a cellular telephone the first antenna may be active to radiate and received the radio frequency signals, and when same antenna assembly is connected to a PCS telephone, the second antenna becomes active to radiate and received the radio frequency signals.

DETAILED DESCRIPTION OF THE INVENTION

Figure 1:
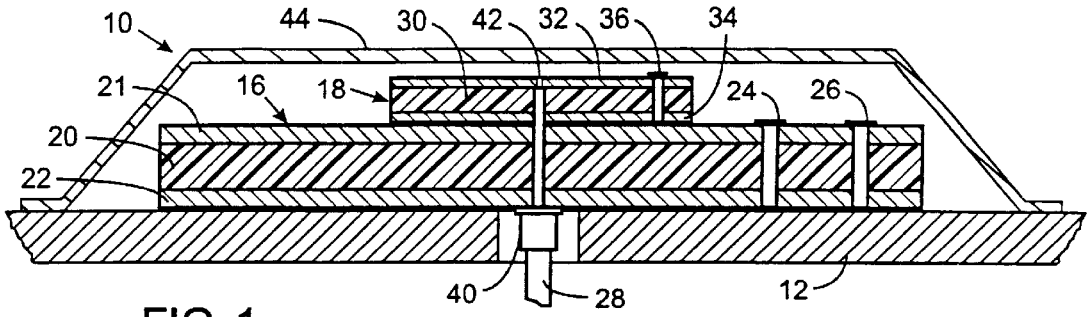
FIG. 1 is a cross sectional view of a low-profile antenna assembly according to the present invention.
Figure 2:
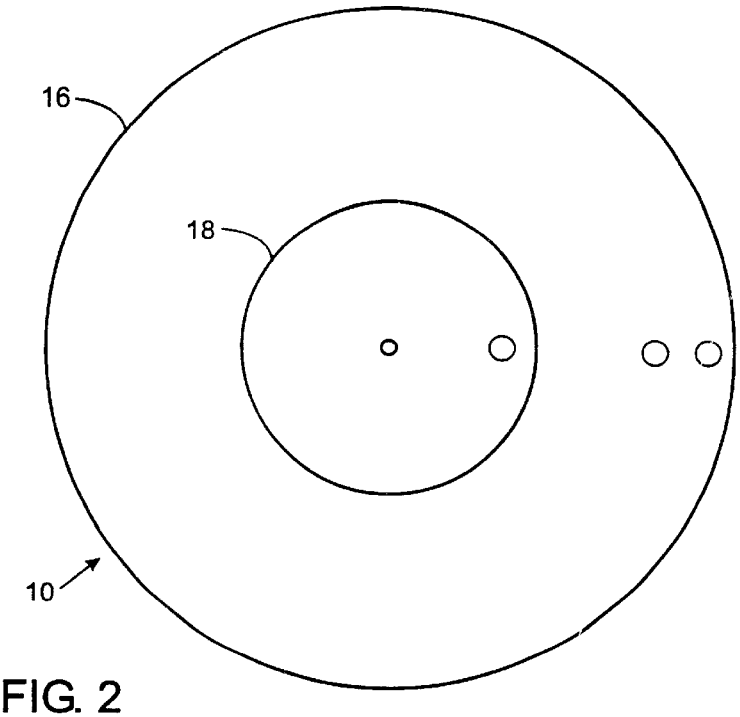
FIG. 2 is a plane view of the top of an internal combination of antennae in the antenna assembly.

With initial reference to FIGS. 1 and 2, a dual frequency band antenna assembly 10 according to the present invention is mounted on a flat surface, such as the roof 12 of a motor vehicle. The antenna assembly 10 comprises a first antenna 16 for cellular telephone communication and a second antenna 18 for PCS telephone communication.

The first antenna 16 is formed by a disk-shaped first substrate 20 of a dielectric material, such as PMI foam or a PTFE composite. The diameter of the first substrate 20 is less than one-half the wavelength of the radio frequency signals which the antenna is to transmit and receive. Limiting the diameter in this matter prevents high order modes from being excited. For frequencies commonly used for cellular telephone transmission, the first substrate 20 is three inches in diameter and one-half inch thick, for example.

The top and bottom flat major surfaces on opposite sides of the first substrate 20 have respective conductive layers 21 and 22, preferably of copper or brass, laminated thereon and covering the entirety of the respective major surface. Two conductive tuning posts 24 and 26 extend through first substrate 20 electrically connecting the first and second conductive layers 21 an 22. Each tuning post 24 and 26 can be a hollow rivet with heads at both ends that are soldered to the respective conductive layer. Alternatively, the tuning posts may be inserted through the first substrate 20 and then the first and second conductive layers 21 and 22 are deposited on the major surfaces of the substrate in electrical contact with the tuning posts. In the exemplary first antenna 16, the tuning posts 24 an 26 are aligned axially on the same side of the center of the first substrate 20. The precise number and locations of the tuning posts are a function of the radio frequencies to be received and/or transmitted by the antenna. In other embodiments, the two tuning posts 24 an 26 may not be axially aligned and at different distances from the center of the first antenna 16. An single frequency antenna of the general type as the first antenna 16 is described in U.S. Pat. No. 5,041,838 entitled "A Cellular Telephone Antenna" which description is expressly incorporated by reference herein.

The second antenna 18 is mounted against the first conductive layer 21 on top of the first antenna 16. The second antenna 18 has a circular disk shaped second substrate 30 of dielectric material similar to the first substrate 20. For frequencies commonly used for PCS telephone transmission, the second substrate 30 is 0.9 inches in diameter and 0.25 inches thick, for example. Both major surfaces of the second antenna 18 have electrically conductive coatings thereon which form third and fourth conductive layers 32 and 34. The fourth conductive layer 34 is in electrical contact with the first conductive layer 21 of the first antenna 16. A tuning post 36, such as a hollow rivet for example, extends through second substrate 30 electrically connecting the third and fourth conductive layers 32 and 34.

A conventional coaxial cable 28 extends through a hole in the motor vehicle roof 12 and is mechanically attached to substantially the geometric center of the first antenna 16. The shield conductor of the coaxial cable 28 is electrically connected by a coupling 40 to the second conductive layer 22 on the bottom of the first antenna 16 and the cable's central conductor 42 is connected to the third conductive layer 21 on top of the second antenna 18. The coaxial cable 28 connects the dual frequency band antenna assembly 10 to a radio frequency transceiver, such as for a cellular and/or PCS telephone for example, within the motor vehicle. When the dual frequency band antenna assembly 10 is connected to a cellular telephone the first antenna 16 is active to radiate and received the radio frequency signals and when the antenna assembly 10 is connected to a PCS telephone the second antenna 18 is active to radiate and received the radio frequency signals.

A decorative and protective plastic cover 44 extends over the combination of the first and second antennae 16 and 18 and may be colored to match or complement the color of the motor vehicle. The sides of the cover 26 are angled for aerodynamic and aesthetic purposes.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

We claim:

1. An antenna assembly comprising:

a first antenna having a first planar substrate of dielectric material with two major surfaces, a first electrically conductive layer on one of the two major surfaces, a second electrically conductive layer on another one of the two major surfaces, and at least one primary electrical shunt connected to the first electrically conductive layer and the second electrically conductive layer;

a second antenna having a second planar substrate of dielectric material with a pair of major surfaces, one of the pair of major surfaces having a third electrically conductive layer thereon and another one of the pair of major surfaces facing the first antenna, the second antenna having at least one secondary electrical shunt connecting the third electrically conductive layer to the first electrically conductive layer of the first antenna; and a pair of electrical conductors each being connected to a different one of the second and third electrically conductive layers to carry communication signals to and from the antenna assembly.

2. The antenna assembly as recited in claim 1 wherein the first antenna is disk-shaped.

3. The antenna assembly as recited in claim 1 wherein the second antenna is disk-shaped.

4. The antenna assembly as recited in claim 1 wherein the first antenna and second antenna are disk-shaped and concentrically aligned.

5. The antenna assembly as recited in claim 1 wherein the a pair of electrical conductors are connected substantially at geometric centers of the second and third electrically conductive layers.

6. The antenna assembly as recited in claim 1 wherein the another one of the pair of major surfaces of the second antenna has a fourth conductive layer thereon.

7. The antenna assembly as recited in claim 6 wherein the at least one secondary electrical shunt connects the third electrically conductive layer to the fourth electrically conductive layer.

8. The antenna assembly as recited in claim 6 wherein the fourth electrically conductive layer contacts the first electrically conductive layer.

9. An antenna assembly comprising:

a first antenna having a first planar substrate of dielectric material with first and second major surfaces, a first electrically conductive layer on the first major surface, and a second electrically conductive layer on the second major surface, the first antenna having an electrical shunt extending through the first planar substrate and connected to the first and second electrically conductive layers;

a second antenna having a second planar substrate of dielectric material with third and fourth major surfaces, a third electrically conductive layer on the third major surface, and a fourth electrically conductive layer on the fourth major surface, wherein the fourth electrically conductive layer abuts the first electrically conductive layer of the first antenna, and the second antenna having an electrical shunt extending through the second planar substrate and connected to the third and fourth electrically conductive layers; and a transmission medium which carries communication signals to and from the antenna assembly, and having a first electrical conductor connected to the second electrically conductive layer and a second electrical conductor connected to the third electrically conductive layer.

10. The antenna assembly as recited in claim 9 wherein the first antenna is disk-shaped.

11. The antenna assembly as recited in claim 9 wherein the second antenna is disk-shaped.

12. The antenna assembly as recited in claim 9 wherein the first antenna and second antenna are disk-shaped and concentrically aligned.

13. The antenna assembly as recited in claim 12 wherein the first and second electrical conductors are connected substantially at geometric centers of the second and third electrically conductive layers.

14. The antenna assembly as recited in claim 9 wherein a transmission medium comprises coaxial cable with a shield forming the first electrical conductor and a central conductor forming the second electrical conductor.

15. An antenna assembly comprising:

a first antenna having a planar first electrode and a planar second electrode parallel to the first electrode with a dielectric material there between, and at least one primary electrical shunt electrically connected to the first electrode and the second electrode;

a second antenna having a planar third electrode parallel to the first electrode with dielectric material there between, and having at least one secondary electrical shunt connecting the third electrode to the first electrode; and a pair of electrical conductors each being connected to a different one of the second and third electrodes to carry communication signals to and from the antenna assembly.

16. The antenna assembly as recited in claim 15 wherein the first electrode and the second electrode are disk-shaped.

17. The antenna assembly as recited in claim 15 wherein the first electrode, the second electrode, and the third electrode are disk-shaped and concentrically aligned.

18. The antenna assembly as recited in claim 15 wherein the pair of electrical conductors are connected substantially at geometric centers of the second and third electrode.

19. The antenna assembly as recited in claim 15 wherein third electrode is on a remote side of the first electrode.

20. The antenna assembly as recited in claim 15 wherein the second antenna further comprises fourth electrode between the first and third electrodes.

21. The antenna assembly as recited in claim 20 wherein the at least one secondary electrical shunt connects the third electrode to the fourth electrode.

22. The antenna assembly as recited in claim 20 wherein the fourth electrode contacts the first electrode.

* * * * *